US008919246B2

(12) United States Patent
Salda et al.

(10) Patent No.: US 8,919,246 B2
(45) Date of Patent: Dec. 30, 2014

(54) WASTE COMPACTOR

(75) Inventors: Luciano Salda, Marano Sul Panaro (IT); Angelo Cappi, Vignola (IT); Georgi Dimitrov Todorov, Sofia (BG)

(73) Assignee: C.M.S. S.p.A., Province of Modena (IT)

( * ) Notice: Subject to any disclaimer, the term of this patent is extended or adjusted under 35 U.S.C. 154(b) by 0 days.

(21) Appl. No.: 13/822,572

(22) PCT Filed: Sep. 8, 2011

(86) PCT No.: PCT/EP2011/065522

§ 371 (c)(1),
(2), (4) Date: May 31, 2013

(87) PCT Pub. No.: WO2012/034917

PCT Pub. Date: Mar. 22, 2012

(65) Prior Publication Data

US 2013/0247782 A1 Sep. 26, 2013

(30) Foreign Application Priority Data

Sep. 15, 2010 (IT) ..... BO2010U0093

(51) Int. Cl.
*B30B 9/12* (2006.01)
*B30B 9/18* (2006.01)
*B30B 9/30* (2006.01)

(52) U.S. Cl.
CPC . *B30B 9/128* (2013.01); *B30B 9/18* (2013.01); *B30B 9/3096* (2013.01); *B30B 9/3082* (2013.01); *B30B 9/3039* (2013.01)
USPC ..... 100/117; 100/131

(58) Field of Classification Search
CPC ..... B30B 9/128; B30B 9/18; B30B 9/3096; B30B 9/3082; B30B 9/3039
USPC ..... 100/117, 131, 145, 146
See application file for complete search history.

(56) References Cited

U.S. PATENT DOCUMENTS 2,397,758 A 3/1946 Sharp
3,606,831 A * 9/1971 Hoffmann ..... 100/145

(Continued)

FOREIGN PATENT DOCUMENTS

WO WO 99/07625 2/1999
WO WO 2004/062900 7/2004
WO WO 2007/057295 5/2007

OTHER PUBLICATIONS

International Search Report for PCT/EP2011/065522 dated Dec. 2, 2011.

(Continued)

*Primary Examiner* — Jimmy T Nguyen
(74) *Attorney, Agent, or Firm* — Marvin Petry; Stites & Harbsion PLLC

(57) ABSTRACT

The waste compactor comprises a housing having an inclined wall in the upper part thereof. A motor on the upper wall drives a helical screw on the lower side of the inclined wall which converges conically downwardly with a decreasing pitch. A lower hopper extending downwardly from the inclined wall below the helical screw forms a funnel and is opened above to an inlet area. The inlet area receives waste material to be compacted, which material descends into the area of the helical screw. A lower more narrow end of the helical screw is located in a conduit which is slightly wider than the lower end of the helical screw and converges downwardly to a constriction at its lower end. Waste material is compacted by downward movement under the action of the helical screw and by being forced through the conduit. The lower hopper has drainage holes through which liquid can drain, by gravity, and a collector is positioned to collect the liquid passing through the drainage holes.

12 Claims, 2 Drawing Sheets

(56) References Cited

U.S. PATENT DOCUMENTS

| | | | | | |
|---|---|---|---|---|---|
| 3,688,687 | A | * | 9/1972 | Craig et al. | 100/117 |
| 4,256,035 | A | | 3/1981 | Neufeldt | |
| 4,852,817 | A | * | 8/1989 | Tipton | 241/260.1 |
| 4,859,322 | A | * | 8/1989 | Huber | 210/162 |
| 5,122,263 | A | * | 6/1992 | Huber | 210/110 |
| 8,312,809 | B2 | | 11/2012 | Salda | |

OTHER PUBLICATIONS

Written Opinion of the International Searching Authority for PCT/EP2011/065522 dated Dec. 2, 2011.

* cited by examiner

WASTE COMPACTOR

BACKGROUND OF THE INVENTION

The invention relates to a waste compactor, of simplified construction and of small dimensions, which is particularly suitable for positioning under or near the counter of a bar, cafeteria or other small restaurant business, for the purpose of compacting empty plastic bottles, glasses, cups and other small items of used tableware made from plastic material and/or paper, and/or other small solid wastes possibly including liquid residues, with the aim of substantially limiting the volume occupied by these wastes and thus facilitating their disposal by the producers of these wastes and by the parties responsible for collecting them and transporting them to the final recycling and/or disposal centres. The compactor according to the invention is also capable of separating any small liquid component from the solid wastes, thus enabling this liquid component to be collected and disposed of separately from the solid component. The closest prior art to the invention can be identified as the published European patent application EP 2 125 352 (Screw press for compacting solid waste) and the published U.S. Pat. No. 2,397,758 (Pulping machine). The former patent application discloses the use of a first horizontal waste feeding screw limited to a single cylindrical spiral or helix, of limited length, attached at one end to and projecting from support and rotation means, and the use of a screw press which can be located axially in the feed spiral or which can be positioned parallel to and outside the spiral in a separate housing, to receive the wastes which have been fed and initially pressed by the first spiral and to compact them, with the aid of calibrated constriction means which operate at the discharge opening of the press. Drainage means are provided at the base of the stator of the first feed spiral, where any liquid present in the waste tends to accumulate by gravity, for the collection and removal of this liquid. The latter of the aforementioned patents relates to a press having a stator body in the form of a truncated cone with a horizontal axis, in which there is an axially rotatable shaft to which are fixed the ends of a transport spiral which operates at a short distance from the inner longitudinally ribbed surface of the conical body, a plurality of curved blades, suitably offset from each other, being mounted on this shaft. The end of the stator of the device having the greater diameter has an opening in its upper part with a hopper for feeding the product to be pressed, while the lower part of the end of the stator of the device having the smaller diameter has a discharge opening closed by a hatch which can be opened manually. The lower part of the stator of the device is pierced and is surrounded externally by a chamber for collecting liquid which can be discharged by gravity. The product to be pressed is pushed from the wider to the narrower end of the device, by the action of the transport spiral, and is pressed by the force of this spiral, by the progressive decrease in pitch and by the progressive constriction of the cross section of the spiral and of the conical stator in which the spiral rotates, while the product is progressively shredded by the curved blades which have a progressive cutting action with a reduced force on the drive shaft of the device. The liquid produced by the pressing is collected in the drainage circuit lying below and the spent compacted material is discharged through the final discharge opening when it is cyclically opened.

The first of the aforesaid devices cannot be constructed with smaller overall dimensions, since the screw press is positioned horizontally, and therefore the material leaving the discharge opening has to be collected by means extending under and beyond this opening, thus unavoidably increasing the overall dimensions of the device in plan view. The second of the aforesaid devices has a simpler construction than the first, but is subject to the same problem as the first device and cannot provide the required degree of compaction. If this device were positioned with its axis vertical and with the discharge at the bottom, in order to occupy a smaller area in plan view, it would no longer be capable of separating the liquid component from the solid component of the pressed product.

SUMMARY OF THE INVENTION

The invention is intended to overcome the limitations of the prior art for the provision of a compacting device for the aforesaid purposes, The characteristics of the invention, and the advantages derived therefrom, will be made clear by the following description which refers to the figures on the two attached sheets of drawings, in which:

BREIF DISCRIPTION OF THE DRAWINGS

DETAILED DISCRIPTIONOF THE PREFERED EMBODIMENTS

Figure 1:
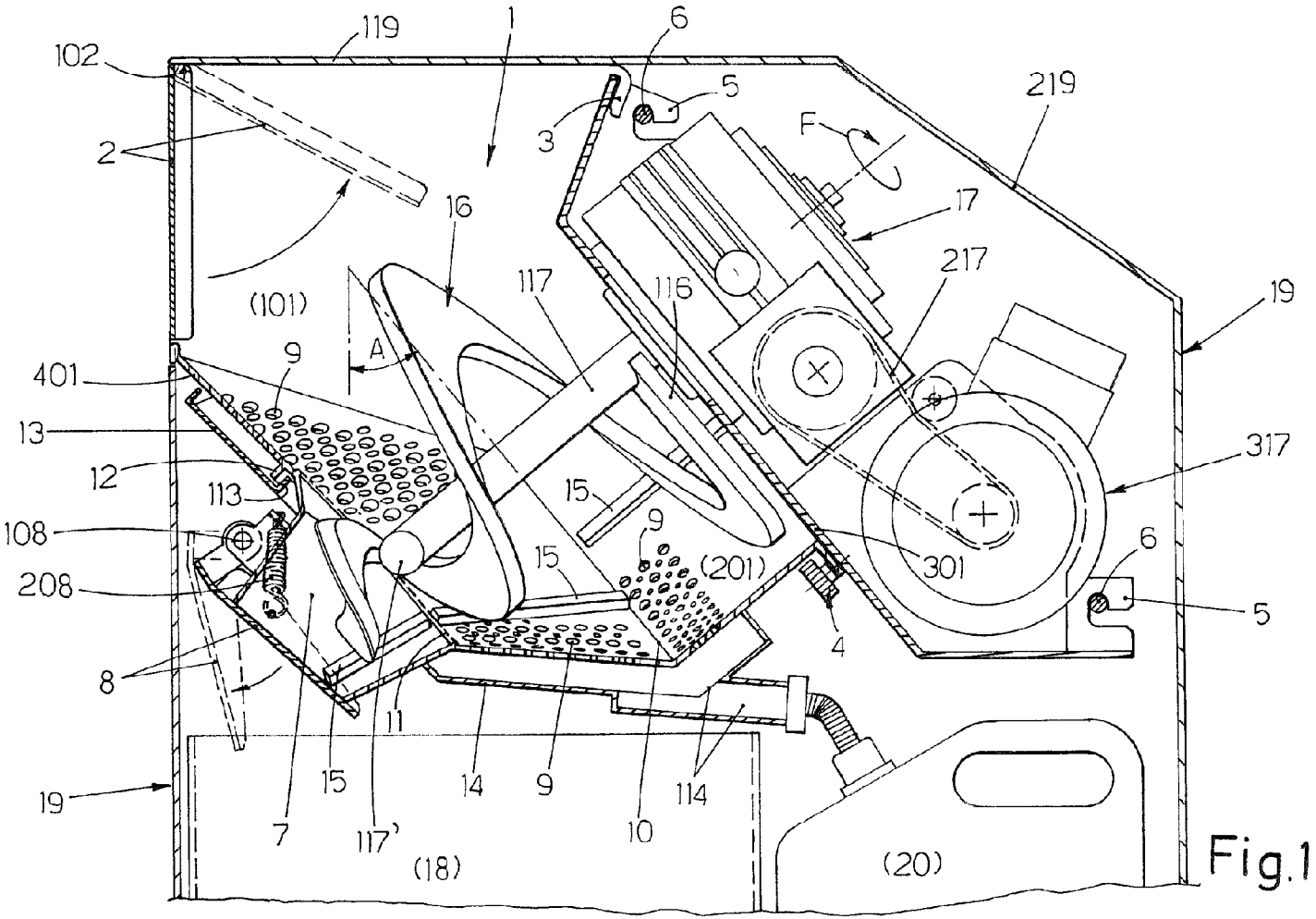
FIG. 1 shows the novel compacting device in side elevation, with parts in section.

As shown in the drawings, the device comprises a hopper 1 with an upper portion 101 provided, laterally for example, with a hatch 2, for example a hatch oscillating about a horizontal upper axis 102 in such a way that it naturally remains closed by the effect of gravity. When the hatch 2 is opened, for example by pushing it into the hopper, or inlet area 1, as shown in broken lines in FIG. 1, the side of the hopper is open for the introduction of the waste to be compacted. Under the upper portion 101, the hopper 1 has a further descending portion 201, whose longitudinal axis forms an acute angle A having an appropriate size of about 30-50°, for example about 40°, with the vertical axis of the upper portion 101. As shown in detail in FIG. 2, the wall 301 of the second portion 201 of the hopper is formed by an independent structure which is, for example, attached, in its upper part for example, to suitably positioned areas 3 of the hopper, and which is then fixed, in its lower part at least, to the hopper by means of a screw knob 4 or other suitable means. This wall 301 has lateral hooks 5 in its upper and lower parts, by which it can be suspended securely on supporting cross members or pivots 6 of a removable containing enclosure 19 of the device, which is described more fully below.

The wall 401 of the hopper 1 is substantially parallel to the inclined wall 301 and has, in a central lower position, the inlet opening which is the opening of greater diameter of a compaction and discharge conduit 7 of truncated conical shape, which has a small cross section and limited length, the lower outlet opening of this conduit being shut off by constriction means of any suitable type, comprising for example a small hatch 8 oscillating about a horizontal upper axis 108 and urged towards a closed position by calibrated or calibratable resilient means 208, the whole arrangement being such that the compacted product leaving the conduit 7 tends to be discharged towards the centre of the underlying part of the device in question (see below).

Figure 2:
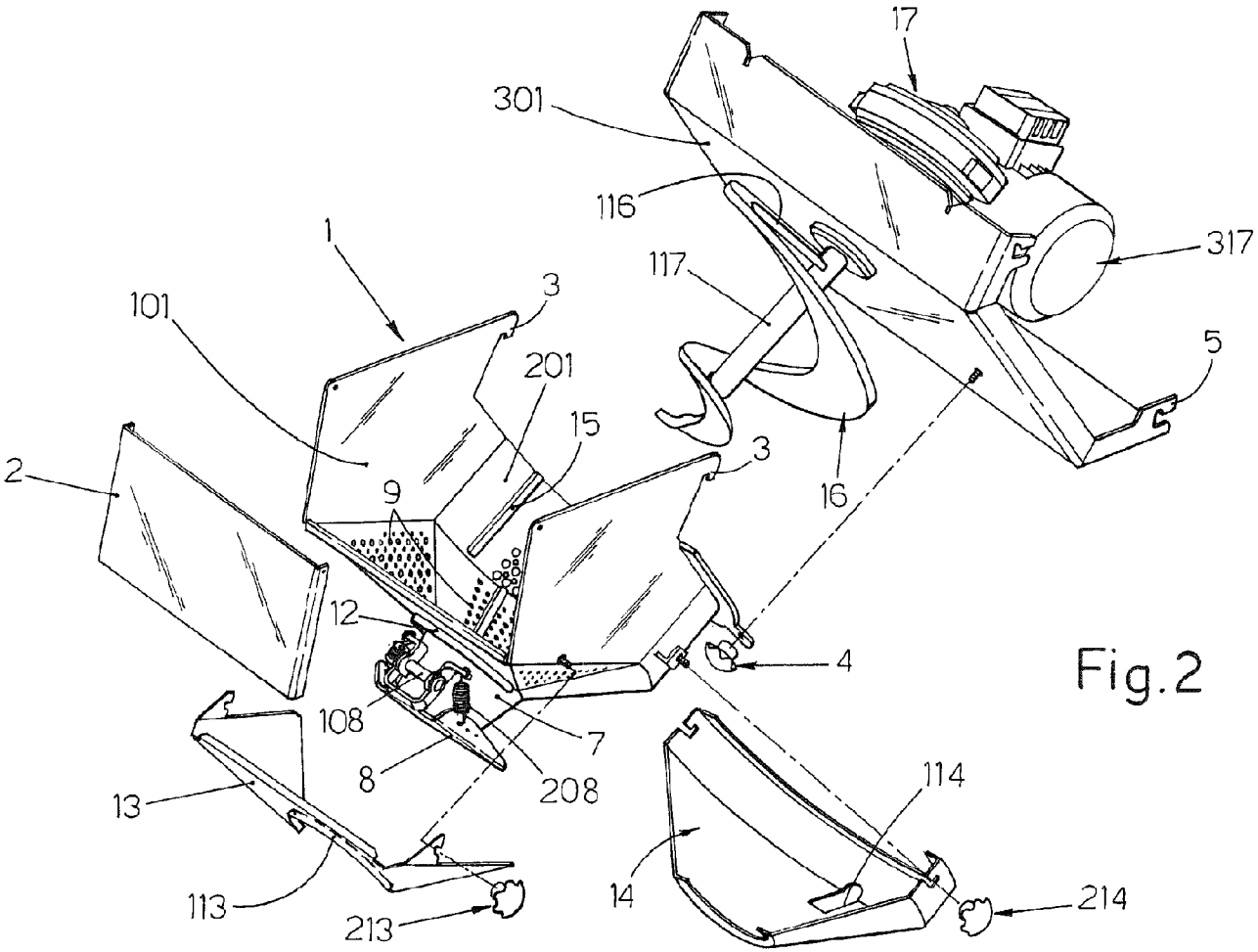
FIG. 2 shows the device of FIG. 1 in perspective and partially broken down into its principal components.

The lower part 201 of the hopper 1 has a lower shape which is at least semi-conical or, as shown in the drawings, is a shape which is semi-cylindrical in the portion near the wall 301 and which extends towards the conduit 7 in a semi-conical form, in such a way that the area 10 of connection between these portions is at the lowest level and any liquid present in the waste to be compacted tends to flow into this area by gravity. As shown in FIG. 1, the inlet opening of the discharge conduit 7 can be surrounded by a small annular projecting bead 11 with a rounded profile, shown in broken lines, which acts as a barrier to prevent the outflow of the liquids from the conduit 7, but which is designed so as not to create a significant obstruction to the flow of the product to be compacted towards the conduit 7. The walls of the lower part 201 of the hopper are provided with small drainage holes 9. A drip strip 12 in the form of an inverted U is welded externally on the wall 401 of the hopper, around the upper and upper middle part of the discharge opening 7, this drip strip accommodating the inner edge 113 of the grooved profile (FIG. 1) of an upper tray 13 which collects the liquid leaving the upper drainage holes 9 and discharges it by gravity into a lower tray 14, which partially overlaps the first tray 13 and collects the liquid leaving the lower parts through the additional drainage holes 9 and through the base 10 of the hopper, and which is provided in its lowest part with an opening with a discharge conduit 114 out of which all the liquid drained through the drainage holes 9 flows (see below). Suitable male and female screw means 213 and 214 are provided for the removable fastening of the trays 13 and 14 to the hopper 1 (FIG. 2).

The inner surfaces of the discharge conduit 7 and of the lower area 201 of the hopper 1 are provided with longitudinal and preferably projecting ribs 15 which promote the flow of the product from the hopper to the discharge conduit 7 with the aid of a transport and compaction spiral or helical screw 16, of truncated conical shape, made for example from a steel plate, positioned with its axis aligned with that of the conduit 7 and of the lower semi-conical portion 201 of the hopper, converging downwards and with a pitch decreasing progressively downwards, and fixed to the slow output shaft 117 of a reduction gear unit 17, which is fixed to the outer face of the wall 301 of the hopper, and which is driven, by means of any suitable transmission system 217, by an electric motor 317 which is also fixed to the wall 301. The lower end of the spiral 16 enters the compaction and discharge conduit 7, substantially occupying half or more of the length of the conduit. In the example shown in the drawings, the shaft 117 extends axially as far as the inlet opening of the conduit 7, where it terminates in an oblique cut-off shape 117' by means of which the shaft is welded axially to the final portion of the spiral 16. The upper end of the spiral 16 is provided with a substantially radial arm 116 which is also welded to the shaft 117. However, the scope of the invention also includes a minor constructional variant in which the spiral 16 can be fixed to the shaft 117 by only one of its ends, or by only the lower or the upper end. In the latter case, the shaft 117 can have the minimum length required for its purpose, the advantage of this arrangement being that it does not axially engage in the spiral 16 and the hopper 1 and does not accumulate on itself any string-like waste which may require periodic intervention for its removal. In the case in which the spiral 16 is fixed to the shaft 117 by its upper end only, any mechanical connecting means can be provided, these means being designed to ensure that the dynamic balance of the rotating element is correct.

The reduction gear unit 17 rotates the spiral 16 in the direction indicated by the arrow F at a speed such that the waste, which is thrown in a loose state into the hopper 1 and which flows in a converging way by gravity into the lower part 201 of the hopper where the spiral 16 operates, is picked up by the spiral 16, which, because of its direction of rotation and the ribs 15 of the stator body 1, 7, forcibly drives and impels the waste downwards and subjects it to a high initial degree of compaction as a result of the progressive downward decrease of its pitch and the conical and downwardly decreasing shape of the spiral and the corresponding final lower part of the conduit 7 which, because of its conical shape and small diameter and the presence of the constriction means 8, 108, 208 at its discharge opening, causes the waste to be additionally compacted and maintained in the compacted state in which the waste is subsequently discharged and falls into an underlying container 18, housed in the form of a drawer, for example, or in any other removable way, in the lower part of an enclosure 19 (FIG. 1) in which the device according to the invention is housed and which also houses removably in a lower position a small tank 20 for collecting the liquids leaving the conduit 114. The enclosure 19 can be provided with wheels, and contains the fixed cross members or pivots 6 for supporting the device. The upper wall 119 of the enclosure, covering the hopper 1, can be made wholly or partially of transparent material and/or can be made removable to facilitate the routine and emergency maintenance of the device. The part 219 of the enclosure lying above the reduction gear drive unit 17, 217, 317 can also be made removable and can advantageously be provided with ventilation slits to dissipate the heat generated by the electric motor 317, in a way which will be evident to persons skilled in the art.

Suitable safety means are to be provided to reverse the rotation of the motor 317 automatically if the motor is subjected to overload, or to stop it if such overloads are repeated and persistent. Suitable safety means are also to be provided to stop the motor 317 automatically when the hatch 2 is open and to indicate to the user the periodic need to empty the bag or container 18 or the tank 20. Clearly, the liquids can alternatively be disposed of directly into the sewers where this is possible.

The invention claimed is:

1. A waster compactor comprising:

a housing:

an inclined wall located in an upper part of the housing, a motor mounted on the upper side of the inclined wall, the motor connected to a shaft extending downwardly from the inclined wall and at an angle to the vertical, a helical screw connected to the shaft, the helical screw converging conically downwardly and decreasing downwardly in pitch, a lower hopper extending downwardly from the inclined wall below the helical screw to form a funnel below the helical screw, the lower hopper being opened above the helical screw, an inlet area above the helical screw for receiving waste material to be compacted, the inlet area opened into the helical screw and lower hopper so that waste material received in the inlet area descends into the helical screw and the lower hopper, the lower narrower end of the helical screw located in a conduit which is slightly wider than the lower, narrower end of the helical screw, the conduit being narrower in diameter than the lower hopper and downwardly converging, the lower end of the conduit having a constriction, the waste material being compacted by its downward movement under the action of the helical screw and by being forced by the helical screw through the conduit and its constriction, and the lower hopper having drainage holes through which liquid collecting in the lower hopper can drain by gravity, a collector positioned to collect liquid passing through the drainage holes.

2. A waste compactor according to claim 1, wherein the inclined wall on which the motor is mounted is removable mounted to the housing.

3. A waste compactor according to claim 2, wherein the removable mounting of the inclined wall to the housing comprises projections or hooks on the housing and mating projections or hooks on the incline wall, by which the inclined wall can be suspended from the housing.

4. A waste compactor according to claim 1, wherein the helical screw is connected at its upper and lower ends to the shaft, the lower end of the shaft terminating above the conduit.

5. A waste compactor according to claim 1, wherein the helical screw is connected to the shaft only at the upper end of the shaft, that connection being free of any connection to the shaft below said connection at the upper end.

6. A waste compactor according to claim 1, in which the lower hopper forms an acute angle of between 30° and 50° to the vertical.

7. A waste compactor according to claim 6, wherein the acute angel is 40°.

8. A waste compactor according to claim 1, wherein the lower hopper is substantially conically shaped, converging downwardly, and at least partially opened upwardly toward the inlet area, the smaller diameter of the conical shape communicating with the conduit, the upper, larger end of the lower hopper being connected to the inclined wall and being semi-cylindrical, and wherein the lower end of the lower hopper forms a base area in which liquid present in the waste collects by gravity.

9. A waste compactor according to claim 8, including a projecting bead with a rounded profile located at the inlet end of the conduit in order to direct liquid to the base area.

10. A waste compactor according the claim 1, including a tray structure on the bottom of the lower hopper which collects liquid passing through the drainage holes and delivers the liquid to the collector.

11. A waste compactor according to claim 10, wherein the tray structure included an upper tray surrounding the uppermost part of the conduit and a lower tray which communicated with the upper tray and is positioned to collect liquid from the remaining drainage holes.

12. A waste compactor according to claim 11, wherein a drip strip is connected to the bottom of the lower hopper around a part of the conduit and accommodating an inner edge of the upper tray.

* * * * *